US011370462B2

(12) United States Patent
Fukata et al.

(10) Patent No.: US 11,370,462 B2
(45) Date of Patent: Jun. 28, 2022

(54) RAILCAR BODYSHELL

(71) Applicant: KAWASAKI JUKOGYO KABUSHIKI KAISHA, Kobe (JP)

(72) Inventors: Satoshi Fukata, Otsu (JP); Atsuyuki Tokumura, Kobe (JP); Atsushi Sano, Kakogawa (JP); Kazuto Nakai, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 191 days.

(21) Appl. No.: 16/651,154

(22) PCT Filed: Sep. 18, 2018

(86) PCT No.: PCT/JP2018/034341
§ 371 (c)(1),
(2) Date: Mar. 26, 2020

(87) PCT Pub. No.: WO2019/065342
PCT Pub. Date: Apr. 4, 2019

(65) Prior Publication Data

US 2020/0290653 A1 Sep. 17, 2020

(30) Foreign Application Priority Data

Sep. 26, 2017 (JP) ..... JP2017-184922

(51) Int. Cl.
*B61D 17/04* (2006.01)
*B61D 17/02* (2006.01)
(Continued)

(52) U.S. Cl.
CPC ..... *B61D 17/02* (2013.01); *B61D 17/08* (2013.01); *B61D 17/12* (2013.01)

(58) Field of Classification Search
CPC ..... B61D 17/02; B61D 17/08; B61D 17/12; B61D 17/043; B61D 25/00; B61D 17/10; B61D 17/041; B61D 17/06; B61D 17/04
See application file for complete search history.

(56) References Cited

U.S. PATENT DOCUMENTS 5,383,406 A * 1/1995 Vanolo ..... B61D 17/005 105/401
5,784,970 A * 7/1998 Fehr ..... B61D 17/043 105/401
(Continued)

FOREIGN PATENT DOCUMENTS

CN 201484421 U 5/2010
JP H02-246863 A 10/1990
(Continued)

OTHER PUBLICATIONS

Japan Association of Rolling Stock Industries, Rolling Stock Technology, No. 239, pp. 3-21 (2010).

*Primary Examiner* — Mark T Le
(74) *Attorney, Agent, or Firm* — Oliff PLC

(57) ABSTRACT

A double skin structure of a railcar bodyshell includes: a harmonica type structural portion in which a closed space is quadrangular when viewed from a car longitudinal direction; and a truss type structural portion which is located adjacent to the harmonica type structural portion and in which a closed space is triangular when viewed from the car longitudinal direction. A thickness reduced portion is formed in at least one of a region between a car width direction middle portion of a roof bodyshell and a car body circumferential direction middle portion of a cantrail. The thickness reduced portion having a bodyshell thickness that is made small by arranging an inner wall of the thickness reduced portion at
(Continued)

a car exterior side of the inner wall of a region adjacent to the region in which the thickness reduced portion is formed.

20 Claims, 12 Drawing Sheets

(51) Int. Cl.
*B61D 17/08* (2006.01)
*B61D 17/12* (2006.01)

(56) References Cited

U.S. PATENT DOCUMENTS

| | | | | |
|---|---|---|---|---|
| 6,454,345 | B1 * | 9/2002 | Campus | B61D 17/045 296/203.01 |
| 2002/0108531 | A1 * | 8/2002 | Kawasaki | B61D 17/08 105/396 |

FOREIGN PATENT DOCUMENTS

| | | | |
|---|---|---|---|
| JP | H09-221024 | A | 8/1997 |
| JP | H10-095335 | A | 4/1998 |
| JP | H10-138918 | A | 5/1998 |
| JP | 2004-034818 | A | 2/2004 |
| JP | 2004-090850 | A | 3/2004 |
| JP | 4163925 | B2 | 10/2008 |
| WO | 2012/11045 | A1 | 8/2012 |

* cited by examiner

RAILCAR BODYSHELL

TECHNICAL FIELD

The present invention relates to a railcar bodyshell for use in high speed railcars and the like.

BACKGROUND ART

Known is a railcar bodyshell having a double skin structure configured such that an outside plate and an inside plate are coupled to each other by a large number of coupling plates. Examples of the double skin structure include: a truss type double skin structure configured such that a closed space formed by two adjacent coupling plates and one of the inside plate and the outside plate is triangular when viewed from a car longitudinal direction; and a harmonica type double skin structure configured such that as disclosed in PTL 1, a closed space formed by the two coupling plates, the inside plate, and the outside plate is quadrangular when viewed from the car longitudinal direction.

Regarding the railcar bodyshell having the truss type double skin structure, as disclosed in PTL 2, proposed is a method in which: regarding side bodyshells and a roof bodyshell, a bodyshell thickness in a region where a relatively high bending load generated by an atmospheric pressure difference between an inside and outside of a car acts is made large, and a bodyshell thickness in a region where the relatively low bending load acts is made small.

CITATION LIST

Patent Literature

PTL 1: Japanese Laid-Open Patent Application Publication No. 10-95335

PTL 2: Japanese Patent No. 4163925

SUMMARY OF INVENTION

Technical Problem

Although the railcar bodyshell having the truss type double skin structure is widely used, the weight of the railcar bodyshell increases in some cases. On the other hand, when the bending strength of the railcar bodyshell having the harmonica type double skin structure and the bending strength of the railcar bodyshell having the truss type double skin structure are the same as each other, a total length of the coupling plates coupling the inside plate and the outside plate in the railcar bodyshell having the harmonica type double skin structure is shorter than that in the railcar bodyshell having the truss type double skin structure. Therefore, the weight of the railcar bodyshell having the harmonica type double skin structure is easily reduced. However, the railcar bodyshell having the harmonica type double skin structure is low in strength with respect to a shear force (hereinafter may be simply referred to as "shear force") that acts in a direction perpendicular to a circumferential direction of a car body by a pressure load generated by the atmospheric pressure difference between the inside and outside of the car.

Further, according to high speed railcars and the like, even when the pressure outside the car changes, such as when the railcar travels through a tunnel, the inside of the car where passengers and crew members stay is required to have an airtight structure, and the pressure inside the car is required to be maintained substantially constant. When the railcar bodyshell of the high speed railcar or the like is configured to have the harmonica type double skin structure, for example, additional reinforcing frames are necessary to compensate strength poverty with respect to the shear force. With this, the structure of the railcar bodyshell becomes complex, and therefore, the weight of the railcar bodyshell increases, and the productivity of the railcar bodyshell deteriorates.

An object of the present invention to provide a railcar bodyshell having a double skin structure which has strength capable of enduring a pressure load acting by an atmospheric pressure difference between an inside and outside of a car and can be reduced in weight.

Solution to Problem

A railcar bodyshell according to one aspect of the present invention includes: an underframe including a side sill; a side bodyshell; and a roof bodyshell. The side bodyshell, the roof bodyshell, and the side sill include a double skin structure, the double skin structure including an inner wall, an outer wall, and a plurality of coupling plates coupling the inner wall and the outer wall to each other such that wall surfaces of the inner and outer walls are spaced apart from each other. The double skin structure includes: a harmonica type structural portion in which a closed space formed by the inner wall, the outer wall, and two adjacent coupling plates among the plurality of coupling plates is quadrangular when viewed from a car longitudinal direction; and a truss type structural portion which is located adjacent to the harmonica type structural portion when viewed from the car longitudinal direction and in which a closed space formed by the two coupling plates and one of the inner wall and the outer wall is triangular when viewed from the car longitudinal direction. When viewed from the car longitudinal direction, a thickness reduced portion is formed in at least one of a region between a car width direction middle portion of the roof bodyshell and a middle portion of a cantrail, a region between the middle portion of the cantrail and a pier panel of the side bodyshell, and a region between the pier panel of the side bodyshell and the side sill in the double skin structure, the thickness reduced portion having a bodyshell thickness that is made small by arranging the inner wall of the thickness reduced portion at a car exterior side of the inner wall of a region adjacent to the region in which the thickness reduced portion is formed.

With this, the length of the coupling plate in the thickness reduced portion when viewed from the car longitudinal direction can be reduced, and this can reduce the weight of the coupling plate. Further, the thickness reduced portion is arranged at a position where a bending moment of the railcar bodyshell becomes less than a maximum value. With this, the required strength of the railcar bodyshell can be secured. Therefore, while reducing the weight of the railcar bodyshell, the railcar bodyshell can endure a pressure load generated by a differential pressure between an inside and outside of a car without a reinforcing frame.

Since the double skin structure of the railcar bodyshell includes the truss type structural portion and the harmonica type structural portion, the structural portions can be suitably arranged at appropriate positions of the railcar bodyshell. With this, for example, at a portion of the railcar bodyshell at which portion a shear force is relatively large, the truss type structural portion is arranged so as to be adjacent to the harmonica type structural portion, and at a portion of the railcar bodyshell 1 at which portion the shear force is relatively small, the harmonica type structural portion is arranged. With this, while reducing the weight of the railcar bodyshell by the harmonica type structural portion, the strength of the railcar bodyshell can be secured by the truss type structural portion.

A railcar bodyshell according to another aspect of the present invention includes: an underframe including a side sill; a side bodyshell; and a roof bodyshell. The side bodyshell, the roof bodyshell, and the side sill include a double skin structure, the double skin structure including an inner wall, an outer wall, and a plurality of coupling plates coupling the inner wall and the outer wall to each other such that wall surfaces of the inner and outer walls are spaced apart from each other. At least one of the inner wall, the outer wall, and the plurality of coupling plates has different plate thicknesses at a plurality of positions when viewed from a car longitudinal direction.

According to the above configuration, when viewed from the car longitudinal direction, at least one of the inner wall, the outer wall, and the plurality of coupling plates has different plate thicknesses at a plurality of positions. With this, for example, the plate thickness can be reduced at positions where the strength is relatively high, and the plate thickness can be increased at positions where the strength is relatively low. With this, the required strength of the railcar bodyshell can be obtained while making the weight of the railcar bodyshell smaller than a case where the plate thickness of the entire double skin structure is increased.

Advantageous Effects of Invention

The present invention can provide the railcar bodyshell having the double skin structure which has strength capable of enduring the pressure load acting by the atmospheric pressure difference between the inside and outside of the car and can be reduced in weight.

DESCRIPTION OF EMBODIMENTS

Hereinafter, an embodiment of the present invention will be described with reference to the drawings.

Figure 1:
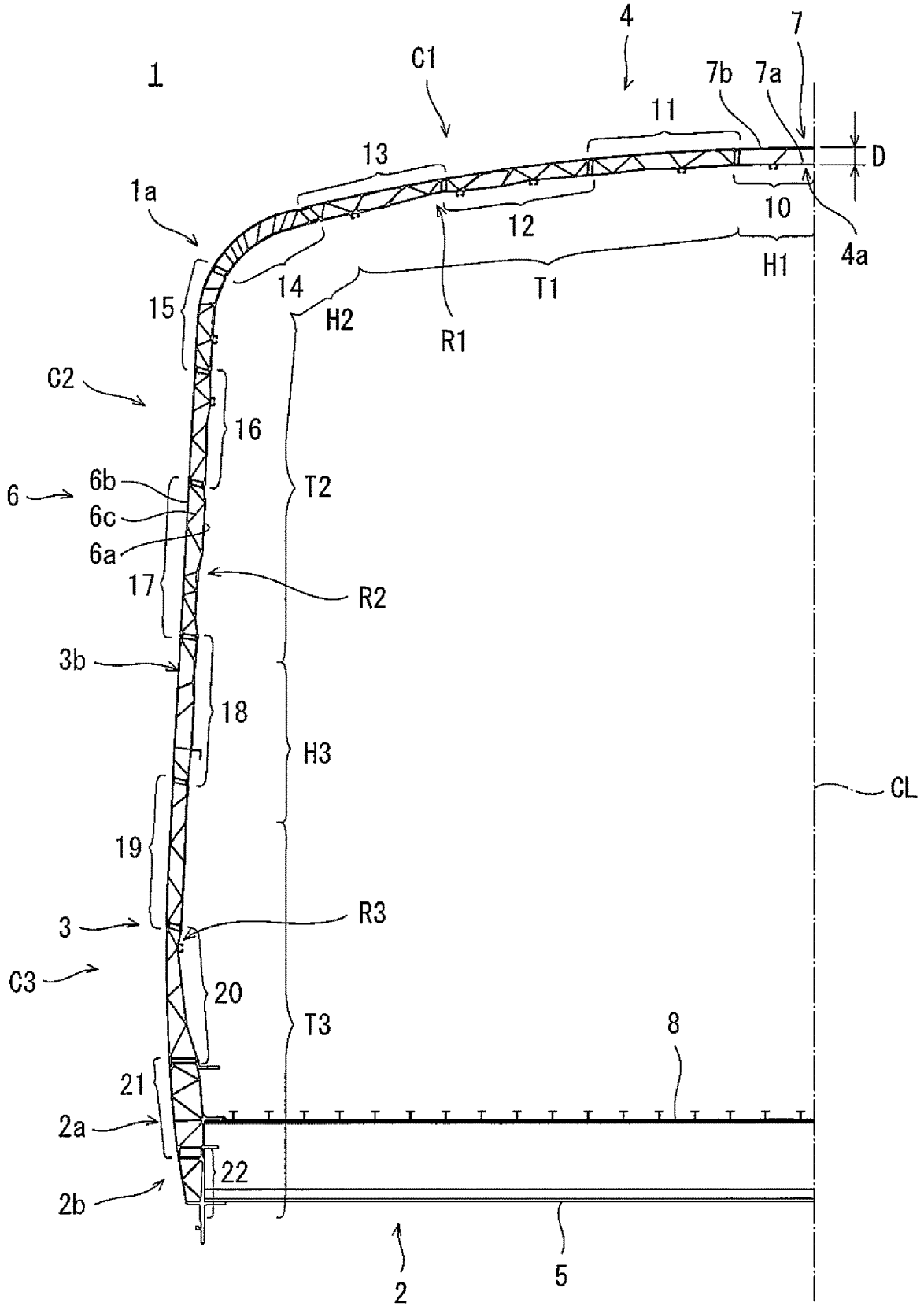
FIG. 1 is a vertical sectional view perpendicular to a car longitudinal direction and showing a railcar bodyshell according to an embodiment.
Figure 2:
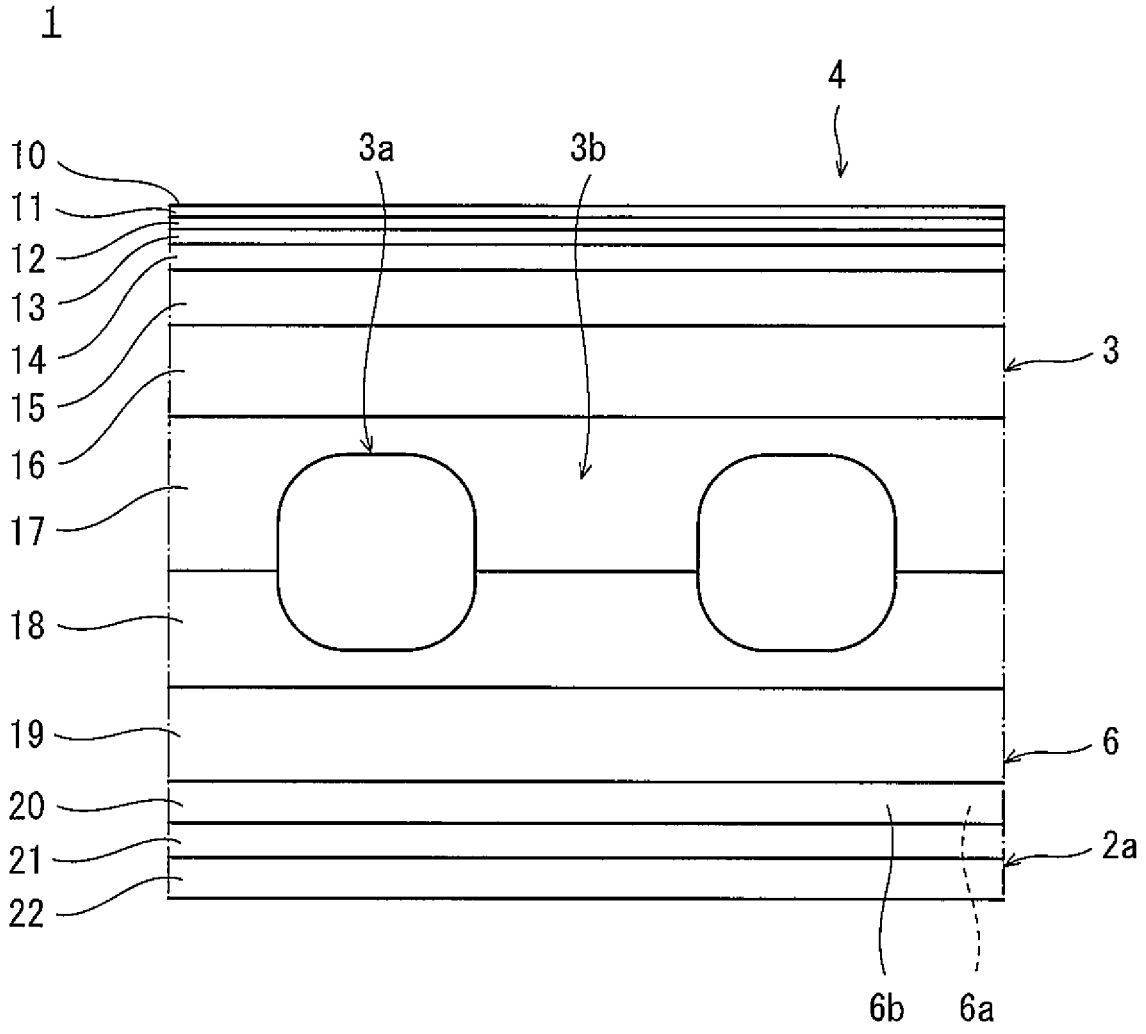
FIG. 2 is a side view of a side surface of the railcar bodyshell of FIG. 1 when viewed from an outside of a car.

FIG. 1 is a vertical sectional view perpendicular to a car longitudinal direction and showing a railcar bodyshell 1 according to the embodiment. FIG. 1 shows a vertical section of a region from a car width direction middle portion of the railcar bodyshell 1 to one end of the railcar bodyshell 1. FIG. 2 is a side view of a side surface of the railcar bodyshell 1 of FIG. 1 when viewed from an outside of a car.

A railcar including the railcar bodyshell 1 of the present embodiment is a high speed railcar. According to this high speed railcar, an inside of a car is kept airtight. When the railcar travels through a tunnel, when high speed railcars pass each other, or the like, a differential pressure is generated between an inside and outside of the car, and a pressure load acts on the railcar bodyshell 1. It should be noted that the railcar including the railcar bodyshell 1 may be a railcar other than the high speed railcar.

As shown in FIGS. 1 and 2, the railcar bodyshell 1 includes an underframe 2, a pair of side bodyshells 3, a roof bodyshell 4, and a pair of end bodyshells (not shown). It should be noted that a section of the railcar bodyshell 1 is symmetrical about a car body center line CL as one example.

The underframe 2 includes a pair of side sills 2*a* and a plurality of cross beams 5 and supports a car body constituted by the side bodyshells 3, the roof bodyshell 4, and the end bodyshells. The plurality of cross beams 5 extend in a car width direction, and both ends of each of the cross beams 5 are connected to the respective side sills 2*a*. In the present embodiment, floor panels 8 are arranged above the cross beams 5 as a floor panel structure. However, a double skin structure connecting the pair of side sills 2*a* may be adopted.

A plurality of windows 3*a* and a plurality of pier panels 3*b* are formed on the side bodyshells 3. The plurality of windows 3*a* are arranged so as to be spaced apart from each other in the car longitudinal direction. The roof bodyshell 4 constitutes a roof of the railcar. One of car width direction ends of the roof bodyshell 4 is coupled to an upper end of the side bodyshell 3 (in the present embodiment, both ends of the roof bodyshell 4 are coupled to respective upper ends of the side bodyshells 3).

The side bodyshells 3, the roof bodyshell 4, and the side sills 2*a* are constituted by a plurality of hollow sections 6. Each of the side bodyshells 3, the roof bodyshell 4, and the side sills 2*a* has a double skin structure including an inside plate 6*a*, an outside plate 6*b*, and a plurality of coupling plates 6*c*. The inside plate 6*a* is arranged at a car interior side of the car body, and the outside plate 6*b* is arranged at a car exterior side of the car body. The coupling plates 6*c* couple the inside plate 6*a* and the outside plate 6*b* to each other such that plate surfaces of the inside and outside plates 6*a* and 6*b* are spaced apart from each other.

Specifically, the side bodyshell 3, the roof bodyshell 4, and the side sill 2*a* include first to thirteenth hollow sections 10 to 22 as the plurality of hollow sections 6. The hollow sections 10 to 22 are arranged in order in a circumferential direction of the car body from an upper side of the railcar bodyshell 1 to a lower side of the railcar bodyshell 1. The hollow sections 10 to 22 are connected to each other in the circumferential direction of the car body by lap joints each formed between the adjacent hollow sections.

The first to fourth hollow sections 10 to 13 are arranged at the roof bodyshell 4. The first hollow section 10 is arranged at a car width direction middle portion 4*a* of the roof bodyshell 4. The fifth and sixth hollow sections 14 and 15 are arranged at a cantrail of the railcar bodyshell 1.

The seventh hollow section 16 is arranged above the pier panel 3*b* of the side bodyshell 3. The eighth and ninth hollow sections 17 and 18 are arranged at the pier panel 3*b* of the side bodyshell 3. The tenth hollow section 19 is arranged under the pier panel 3*b* of the side bodyshell 3. The eleventh hollow section 20 is arranged under the tenth hollow section 19. The twelfth and thirteenth hollow sections 21 and 22 are arranged at positions corresponding to the side sill 2*a* of the underframe 2.

At the side bodyshell 3, the roof bodyshell 4, and the side sill 2*a*, the inside plates 6*a* are coupled to each other to form an inner wall 7*a*, and the outside plates 6*b* are coupled to each other to form an outer wall 7*b*. The plurality of hollow sections 6 are coupled to each other by welding as one example. However, the present embodiment is not limited to this, and the hollow sections 6 may be coupled to each other by, for example, friction stir welding.

A double skin structure 7 includes harmonica type structural portions H1 to H3 and truss type structural portions T1 to T3. The harmonica type structural portion of the present embodiment is arranged at at least one of the car width direction middle portion 4*a* of the roof bodyshell 4, a car body circumferential direction middle portion 1*a* of the cantrail, and the pier panel 3*b* of the side bodyshell 3 (in the present embodiment, the harmonica type structural portions are arranged at all of these members 4*a*, 1*a*, and 3*b*).

Specifically, the harmonica type structural portion H1 is arranged at the middle portion 4*a* of the roof bodyshell 4. The harmonica type structural portion H2 is arranged at the middle portion 1*a* of the cantrail. The harmonica type structural portion H3 is arranged at the pier panel 3*b* of the side bodyshell 3. The harmonica type structural portions H1 to H3 are arranged at portions of the railcar bodyshell 1 at which portions a shear force is relatively small.

In the harmonica type structural portions H1 to H3, when viewed from the car longitudinal direction, a closed space formed by two adjacent coupling plates 6*c* among the plurality of coupling plates 6*c*, the inner wall 7*a*, and the outer wall 7*b* is quadrangular.

When viewed from the car longitudinal direction, two or more (as one example, all) coupling plates 6*c* adjacent to each other in the circumferential direction of the car body among the plurality of coupling plates 6*c* arranged in the harmonica type structural portions H1 to H3 extend in directions intersecting with each other and are not arranged so as to be perpendicular to a plate surface of the inner wall 7*a* and a plate surface of the outer wall 7*b*. Further, the directions in which the coupling plates 6*c* extend are parallel to directions in which the shear force (see FIG. 12) generated by the atmospheric pressure difference between the inside and outside of the car acts.

The truss type structural portions T1 to T3 are arranged at portions of the railcar bodyshell 1 on which portions relatively large shear force acts. Specifically, the truss type structural portion T1 is arranged between the harmonica type structural portions H1 and H2. The truss type structural portion T2 is arranged between the harmonica type structural portions H2 and H3. The truss type structural portion T3 is adjacently arranged under the harmonica type structural portion H3.

In the truss type structural portions T1 to T3, a closed space formed by the two coupling plates 6*c* and one of the inner wall 7*a* and the outer wall 7*b* is triangular.

When the bending strength of the harmonica type structural portion (H1, H2, H3) and the bending strength of the truss type structural portion are the same as each other, a total length of the coupling plates 6*c* and the number of coupling plates 6*c* can be reduced in the harmonica type structural portion, and the thicknesses of the inside and outside plates 6*a* and 6*b* can be reduced in the harmonica type structural portion, and with this, the weight of the railcar bodyshell 1 can be easily reduced. Further, corner angles of the hollow portions in the harmonica type structural portions H1 to H3 are larger than those in the truss type structural portions T1 to T3. Therefore, when manufacturing the hollow sections of the harmonica type structural portions H1 to H3 by extrusion molding, corner angles of a mold can be made large. When the corner angles are large, damage due to wear or the like of such corner portions of the mold hardly occurs. Therefore, manufacturing cost can be reduced by utilizing the harmonica type structural portions H1 to H3.

The windows 3*a* shown in FIG. 2 are formed by subjecting the side bodyshell 3 to a cutting operation. An opening peripheral edge of each window 3*a* needs to be processed in a complex curved shape. However, by using the harmonica type structural portion, the amount of cutting operations can be reduced, and thus, the windows 3*a* are easily formed.

In the present embodiment, the hollow sections 12 to 22 are members formed by extrusion molding. However, some or all of the hollow sections 12 to 22 may be formed by welding the inside plates 6*a*, the outside plates 6*b*, and the coupling plates 6*c*.

Each of the harmonica type structural portions H1 to H3 may partially include a truss type structure, and each of the truss type structural portions T1 to T3 may partially include a harmonica type structure.

Each of the cantrail and the pier panel 3*b* may partially include the truss type structural portion. As one example, in the railcar bodyshell 1, part of the truss type structural portion T2 is located at an upper portion of the pier panel 3*b* so as to be adjacent to the harmonica type structural portion H3.

When viewed from the car longitudinal direction, the double skin structure 7 has different bodyshell thicknesses D at a plurality of positions. To be specific, when viewed from the car longitudinal direction, the bodyshell thickness D of the double skin structure 7 changes in the circumferential direction of the railcar bodyshell 1. With this, the balance between the strength and weight of the railcar bodyshell 1 is optimized.

Specifically, in the railcar bodyshell 1, when viewed from the car longitudinal direction, a thickness reduced portion (R1, R2, R3) is formed in at least one of regions C1, C2, and C3 in the double skin structure 7 (in the present embodiment, the thickness reduced portions R1, R2, and R3 are formed in the respective regions C1, C2, and C3). The region C1 is located between the car width direction middle portion 4*a* of the roof bodyshell 4 and the car body circumferential direction middle portion 1*a* of the cantrail. The region C2 is located between the middle portion 1*a* of the cantrail and the pier panel 3*b* of the side bodyshell 3. The region C3 is located between the pier panel 3*b* and the side sill 2*a*. The thickness reduced portion (R1, R2, R3) has the bodyshell thickness D that is made small by arranging the inner wall 7*a* of the thickness reduced portion at a car exterior side of the inner wall 7*a* of a region adjacent to the region in which the thickness reduced portion is formed.

The thickness reduced portions R1 to R3 are arranged so as to be spaced apart from each other in the circumferential direction of the car body. When viewed from the car longitudinal direction, portions each having the larger bodyshell thickness D than the thickness reduced portions R1 to R3 of the railcar bodyshell 1 are arranged at both respective car body circumferential direction sides of each of the thickness reduced portions R1 to R3. In other words, each of the thickness reduced portions R1 to R3 is a depressed portion formed such that the inner wall 7*a* of the railcar bodyshell 1 is partially depressed toward the outer wall 7*b*.

The thickness reduced portions R1 to R3 extend in the car longitudinal direction. Maximum depths of the thickness reduced portions R1 to R3 when viewed from the car longitudinal direction do not have to be equal to each other. In the present embodiment, as one example, the maximum depth of the thickness reduced portion R1 is larger than each of the maximum depths of the thickness reduced portions R2 and R3.

The thickness reduced portions R1 to R3 are formed at the respective regions C1 to C3 where the bending moment generated by the atmospheric pressure difference between the inside and outside of the car becomes less than a maximum value (in the present embodiment, the bending moment becomes a minimum value) in the railcar bodyshell 1. In the thickness reduced portions R1 to R3, the lengths of the coupling plates 6*c* when viewed from the car longitudinal direction are reduced, and with this, the weight of the railcar bodyshell 1 is reduced.

Car exterior side surfaces of the thickness reduced portions R1 to R3 are formed so as to be smoothly continuous with the outer wall 7*b* and are configured not to influence the appearance shape of the railcar bodyshell 1.

The maximum depth of the inner wall 7*a* at each of the thickness reduced portions R1 to R3 is set based on, for example, the magnitude of the bending moment of the railcar bodyshell 1 at a position where the thickness reduced portion (R1, R2, R3) is formed and the distribution of the bending moment of the railcar bodyshell 1 at the position where the thickness reduced portion (R1, R2, R3) is formed and its peripheral position.

It should be noted that the shapes of the thickness reduced portions R1 to R3 do not have to be the same as each other. Further, for example, each of the thickness reduced portions R1 to R3 may have such a shape when viewed from the car longitudinal direction that the inner wall 7*a* is curved toward the outer wall 7*b*, or the inner wall 7*a* is bent in a wedge shape or a rectangular shape toward the outer wall 7*b*. The shapes of the thickness reduced portions R1 to R3 are not limited.

Further, in the railcar bodyshell 1, the bodyshell thickness D of the double skin structure 7 in the regions (the middle portion 4*a* of the roof bodyshell 4, the cantrail, and the pier panel 3*b* of the side bodyshell 3) where the bending moment is relatively large is set so as to be practically constant. With this, the strength of the railcar bodyshell 1 in these regions is increased.

According to the double skin structure 7, when viewed from the car longitudinal direction, at least one of the inner wall 7*a*, the outer wall 7*b*, and the plurality of coupling plates 6*c* has different plate thicknesses at a plurality of positions (in the present embodiment, each of all of the inner wall 7*a*, the outer wall 7*b*, and the plurality of coupling plates 6*c* has different plate thicknesses at a plurality of positions).

In the double skin structure 7 of the present embodiment, the plate thicknesses of the inner wall 7*a*, the outer wall 7*b*, and the plurality of coupling plates 6*c* are set to large values in regions where the bending moment is large and are set to small values in regions where the bending moment is small. With this, the strength of the bodyshell is increased in the regions where the bending moment is relatively large, and the weight of the bodyshell is reduced in the regions where the bending moment is relatively small.

At least one of the inside plates 6*a*, the outside plates 6*b*, and the coupling plates 6*c* in the hollow sections arranged in the regions (the cantrail and the pier panel 3*b* of the side bodyshell 3) where the bending moment is especially large in the railcar bodyshell 1 among the plurality of hollow sections 6 included in the railcar bodyshell 1 has different plate thicknesses at a plurality of positions when viewed from the car longitudinal direction.

In each of the third hollow section 12, a portion of the fourth hollow section 13 which portion is located close to the middle portion 4*a* of the roof bodyshell 4, a lower portion of the eighth hollow section 17, an upper portion of the ninth hollow section 18, and the tenth hollow section 20, the coupling plates 6*c* are arranged more densely in the circumferential direction of the car body than the other coupling plates 6*c* (for example, the coupling plates 6*c* in the second hollow section 11) in the truss type structural portions T1 to T3. With this, the required strength of the railcar bodyshell 1 is obtained while reducing the weight of the railcar bodyshell 1 by providing the thickness reduced portions R1 to R3.

It should be noted that increasing rigidity at a position where the bending moment is small has an effect of suppressing a deformation amount at a position where the bending moment is large. Therefore, the rigidity at the thickness reduced portions R1 to R3 may be partially increased by partially increasing inside and outside plate thicknesses of the sections located at the thickness reduced portions R1 to R3 or narrowing truss intervals without hindering the weight reduction.

Figure 3:
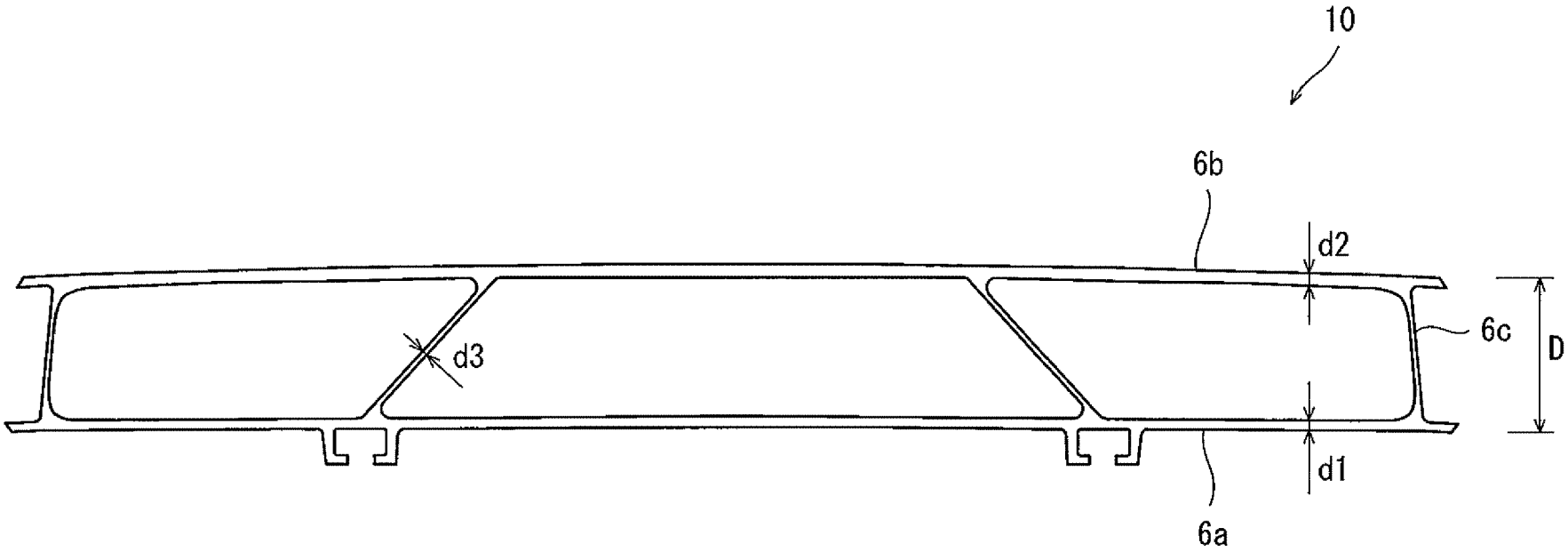
FIG. 3 is a vertical sectional view perpendicular to the car longitudinal direction and showing a first hollow section of FIG. 1.

Hereinafter, the structures of the hollow sections 10, 12 to 15, 17, 18, and 20 will be described as a specific example. FIG. 3 is a vertical sectional view perpendicular to the car longitudinal direction and showing the first hollow section 10 of FIG. 1. As shown in FIG. 3, when viewed from the car longitudinal direction, the thickness (bodyshell thickness D) of the first hollow section 10 is practically constant. When viewed from the car longitudinal direction, each of a plate thickness d1 of the inside plate 6*a* and a plate thickness d2 of the outside plate 6*b* increases from both longitudinal direction ends of the first hollow section 10 toward an inner side.

The plurality of coupling plates 6*c* are located at positions away from each other in the circumferential direction of the car body and are coupled to the plate surfaces of the inside and outside plates 6*a* and 6*b* so as to be inclined relative to the plate surfaces of the inside and outside plates 6*a* and 6*b*. As one example, when viewed from the car longitudinal direction, a plate thickness d3 of each of the coupling plates 6*c* adjacently arranged in the first hollow section 10 other than root portions of the coupling plates 6*c* is set to a minimum plate thickness among the thicknesses of the plurality of coupling plates 6*c* included in the railcar bodyshell 1. As one example, the harmonica type structural portion H1 is constituted by the single first hollow section 10.

Figure 4:
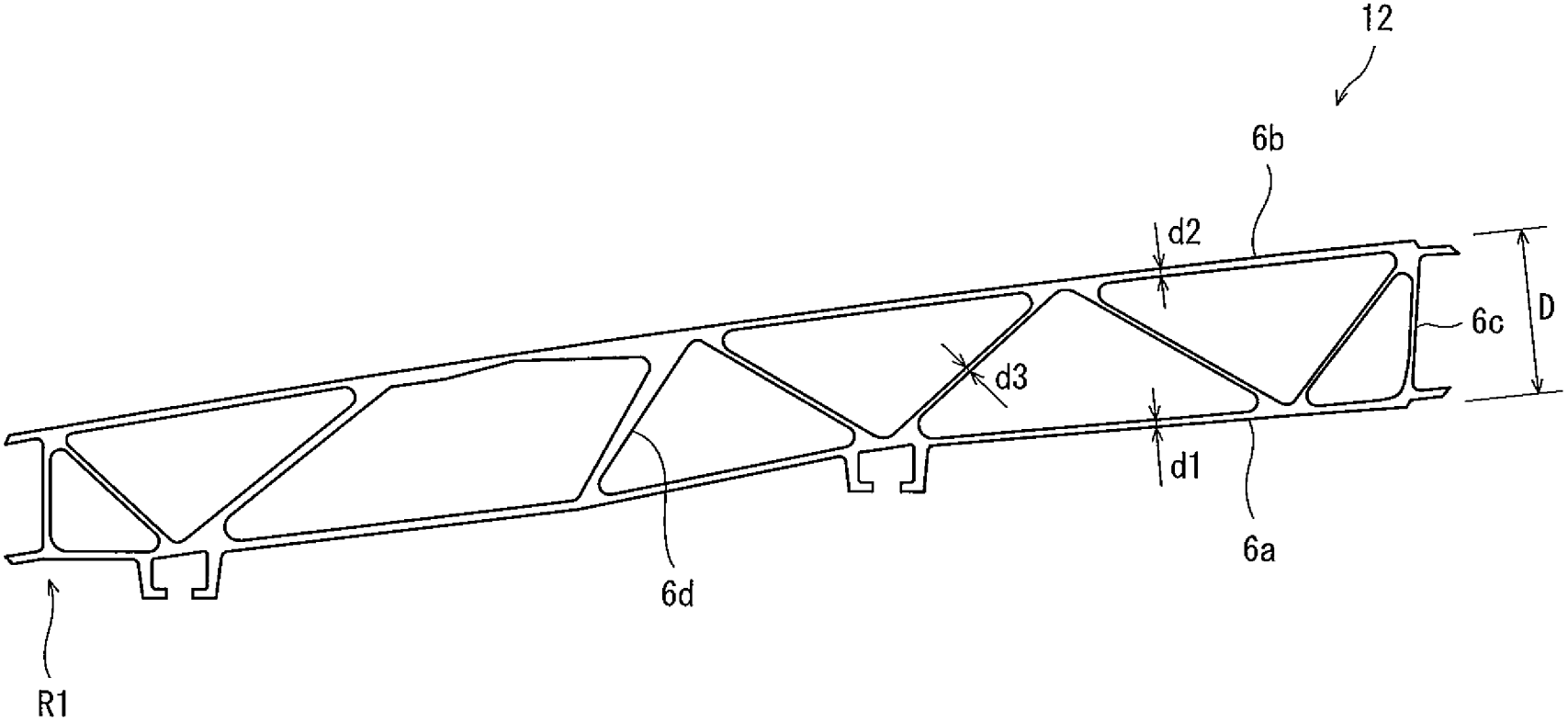
FIG. 4 is a vertical sectional view perpendicular to the car longitudinal direction and showing a third hollow section of FIG. 1.

FIG. 4 is a vertical sectional view perpendicular to the car longitudinal direction and showing the third hollow section 12 of FIG. 1. As shown in FIG. 4, when viewed from the car longitudinal direction, the thickness reduced portion R1 is formed at an end portion of the third hollow section 12 which portion is located close to the cantrail.

The plate thickness d1 of the inside plate 6*a* is relatively small in the thickness reduced portion R1. The plate thickness d1 of the inside plate 6*a* increases once from the thickness reduced portion R1 toward the middle portion 4*a* of the roof bodyshell 4 (from a left side toward a right side on the paper surface of FIG. 4) and is then decreases again. The plate thickness d2 of the outside plate 6*b* partially increases at a position on the cantrail side of a middle of the third hollow section 12. The plate thickness d2 in this region where the plate thickness d2 of the outside plate 6*b* increases decreases from the middle portion 4*a* of the roof bodyshell 4 toward the cantrail (from an upper side toward a lower side on the paper surface of FIG. 4) within a range of values larger than the plate thickness d2 in its peripheral region, and then increases.

Further, any one of the plurality of coupling plates 6*c* includes a gradually decreased region where the plate thickness d3 gradually decreases from one of the car interior side and car exterior side of the car body to the other. In the third hollow section 12 of the present embodiment, for example, a coupling plate 6*d* (the fourth coupling plate 6*c* from the left side on the paper surface of FIG. 4) that overlaps in the bodyshell thickness direction the region where the plate thickness d2 of the outside plate 6*b* increases includes the gradually decreased region where the plate thickness d3 decreases from the car exterior side toward the car interior side.

Figure 5:
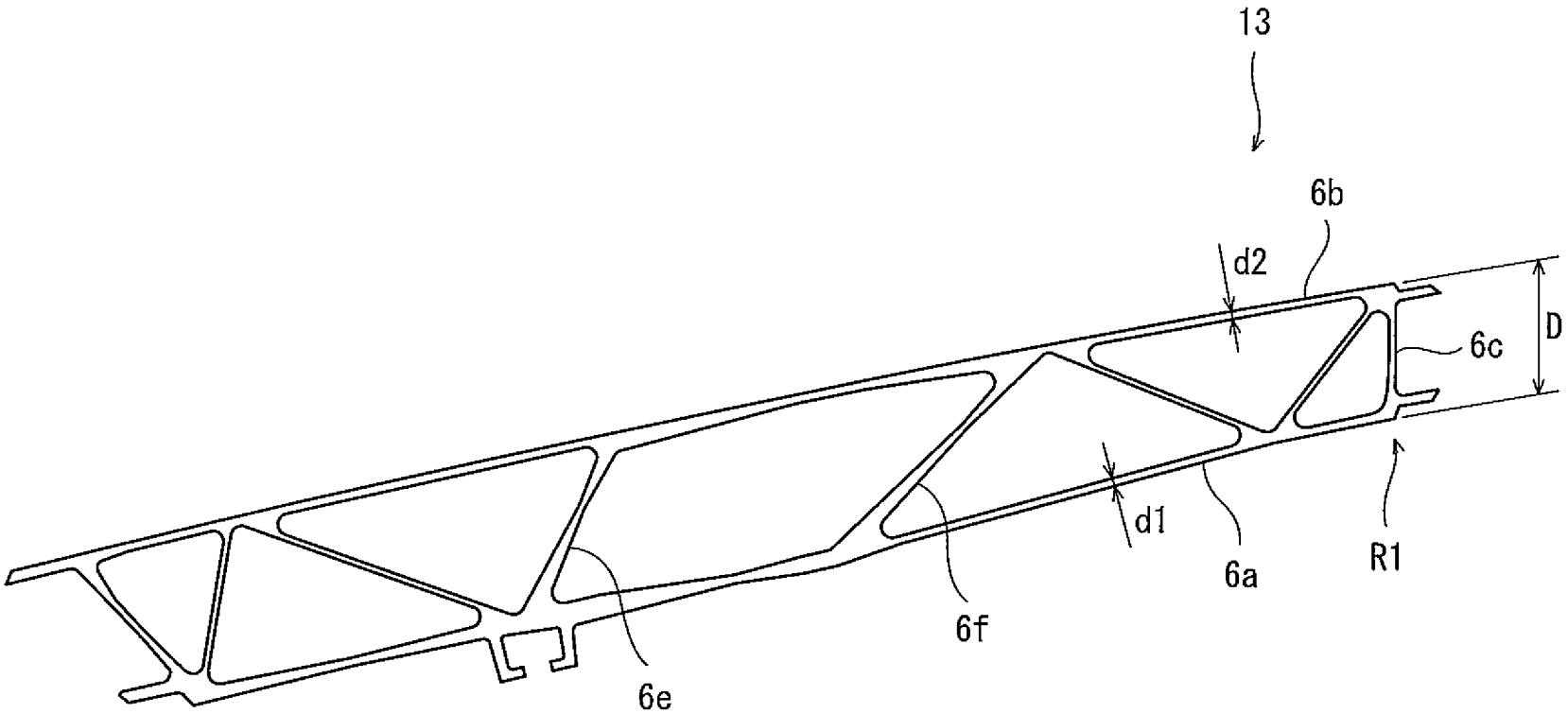
FIG. 5 is a vertical sectional view perpendicular to the car longitudinal direction and showing a fourth hollow section of FIG. 1.

FIG. 5 is a vertical sectional view perpendicular to the car longitudinal direction and showing the fourth hollow section 13 of FIG. 1. As shown in FIG. 5, when viewed from the car longitudinal direction, the thickness reduced portion R1 is formed at an end portion (an upper-side portion on the paper surface of FIG. 5) of the fourth hollow section 13 which portion is located close to the middle portion 4*a* of the roof bodyshell 4. In the railcar bodyshell 1, this thickness reduced portion R1 is continuous with the thickness reduced portion R1 of the third hollow section 12. To be specific, in the present embodiment, the thickness reduced portion R1 is formed at both of the adjacent hollow sections 12 and 13.

The plate thickness d1 of the inside plate 6*a* located between coupled portions of the inside plate 6*a* which portions are coupled to the respective coupling plates 6*c* adjacently located on the cantrail side of a middle of the fourth hollow section 13 (on a lower side of the middle of the fourth hollow section 13 on the paper surface of FIG. 5) is relatively large. Further, when viewed from the car longitudinal direction, the plate thickness d1 of the inside plate 6*a* located between the above coupled portions of the inside plate 6*a* decreases in a direction away from each coupled portion.

The plate thickness d2 of the outside plate 6*b* located between coupled portions of the outside plate 6*b* which portions are coupled to respective coupling plates 6*e* and 6*f* (the fourth and fifth coupling plates 6*c* from the left side on the paper surface of FIG. 5) decreases in a direction away from each coupled portion.

Further, the fourth hollow section 13 includes the coupling plates 6*e* and 6*f* including gradually decreased regions each having the plate thickness d3 that gradually decreases from one of the car interior side and car exterior side of the car body to the other.

With this, each of the coupling plates 6*e* and 6*f* includes two gradually decreased regions that are a region having the plate thickness d3 that gradually decreases from the inside plate 6*a* to a middle portion of the coupling plate (6*e*, 6*f*) and a region having the plate thickness d3 that gradually decreases from the outside plate 6*b* to the middle portion of the coupling plate (6*e*, 6*f*). Portions of the coupling plates 6*e* and 6*f* at which portions the plate thickness d3 becomes a minimum value are optimized in the coupling plates 6*e* and 6*f*.

Figure 6:
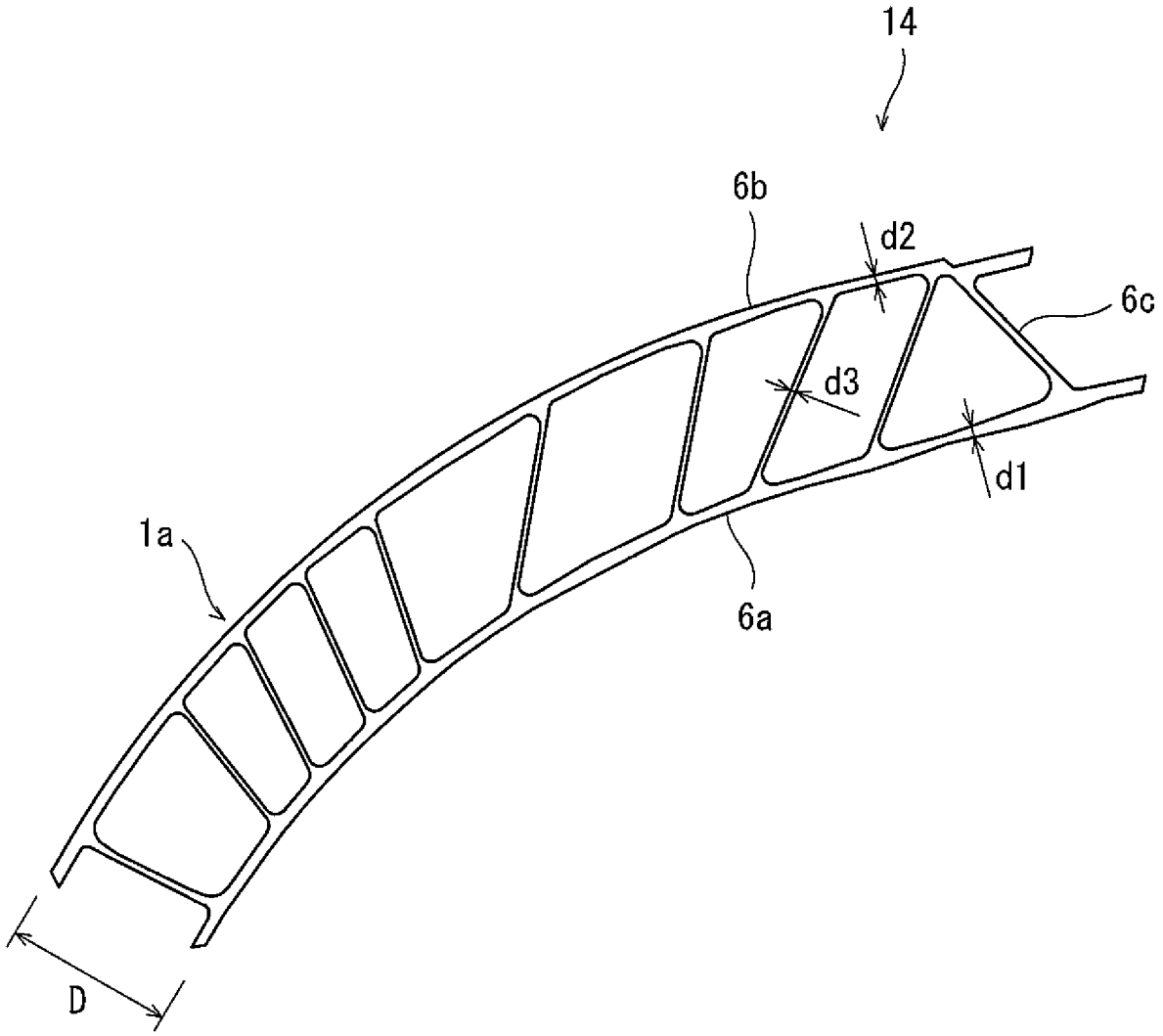
FIG. 6 is a vertical sectional view perpendicular to the car longitudinal direction and showing a fifth hollow section of FIG. 1.

FIG. 6 is a vertical sectional view perpendicular to the car longitudinal direction and showing the fifth hollow section 14 of FIG. 1. As shown in FIG. 6, when viewed from the car longitudinal direction, the fifth hollow section 14 has a curved shape corresponding to the shape of the cantrail.

When viewed from the car longitudinal direction, the thickness (bodyshell thickness D) of the fifth hollow section 14 is practically constant except for an end portion of the fifth hollow section 14 which portion is located close to the middle portion 4*a* of the roof bodyshell 4. The plate thickness d1 of the inside plate 6*a* and the plate thickness d2 of the outside plate 6*b* are optimized by being finely changed in the circumferential direction of the car body. With this, while reducing the weight of the railcar bodyshell 1, the strength of the fifth hollow section 14 is secured such that the railcar bodyshell 1 can endure a load that locally concentrates on the cantrail of the railcar bodyshell 1.

The coupling plates 6*c* are located at positions away from each other and extend in directions intersecting with each other. The directions in which the coupling plates 6*c* extend are parallel to the directions in which the shear force (see FIG. 12) generated at the railcar bodyshell 1 acts.

An average interval between the coupling plates 6*c* in the harmonica type structural portion H2 is narrower than each of an average interval between the coupling plates 6*c* in the harmonica type structural portion H1 and an average interval between the coupling plates 6*c* in the harmonica type structural portion H3 other than the harmonica type structural portion H2. With this, the middle portion 1*a* of the cantrail includes the harmonica type structural portion H2, and although the bodyshell thickness D of the middle portion 1*a* is relatively small, the strength of the middle portion 1*a* is improved.

Figure 7:
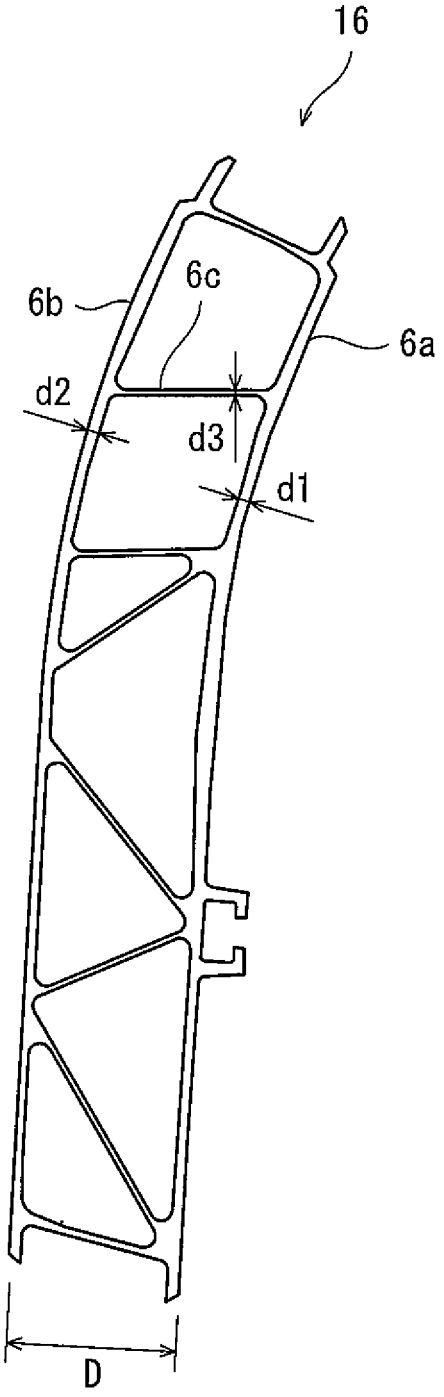
FIG. 7 is a vertical sectional view perpendicular to the car longitudinal direction and showing a seventh hollow section of FIG. 1.

FIG. 7 is a vertical sectional view perpendicular to the car longitudinal direction and showing the seventh hollow section 16 of FIG. 1. As shown in FIG. 7, when viewed from the car longitudinal direction, the seventh hollow section 16 has a curved shape corresponding to the shape of a lower portion of the cantrail.

The thickness (bodyshell thickness D) of the seventh hollow section 16 is practically constant except for an upper end portion of the seventh hollow section 16. The plate thickness d1 of the inside plate 6*a* increases from the middle portion 1*a* of the cantrail toward a lower side of the side bodyshell 3 and then decreases. The plate thickness d2 of the outside plate 6*b* increases from the middle portion 1*a* of the cantrail to the lower side of the side bodyshell 3, then decreases, then increases again at a longitudinal-direction middle of the outside plate 6*b*, and then decreases.

Figure 8:
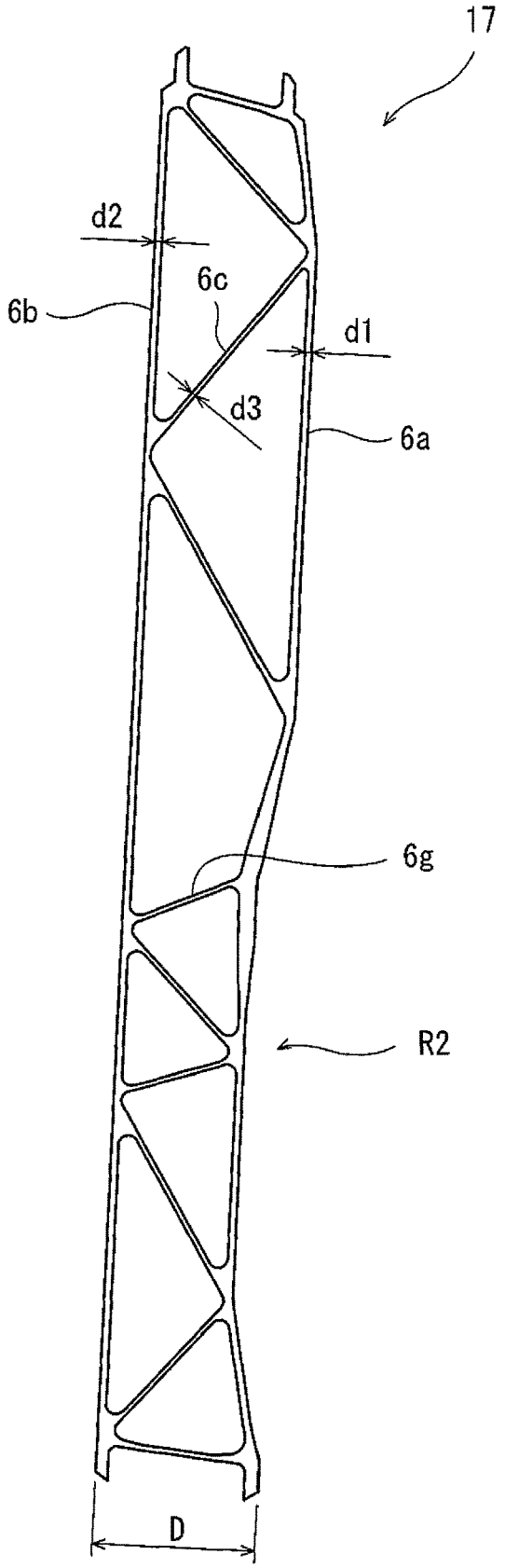
FIG. 8 is a vertical sectional view perpendicular to the car longitudinal direction and showing an eighth hollow section of FIG. 1.

FIG. 8 is a vertical sectional view perpendicular to the car longitudinal direction and showing the eighth hollow section 17 of FIG. 1. As shown in FIG. 8, the thickness reduced portion R2 is formed at the eighth hollow section 17. The plate thickness d1 of the inside plate 6*a* increases from the middle portion 1*a* of the cantrail toward the lower side of the side bodyshell 3, becomes maximum in the thickness reduced portion R2, and then decreases. With this, while reducing the weight, the strength is adequately secured even when a load locally acts on the pier panel 3*b*. A portion of the inside plate 6*a* at which portion the plate thickness d1 becomes maximum is arranged at a coupled portion coupled to a coupling plate 6*g* (in the present embodiment, the sixth coupling plate 6*c* from a lower side on the paper surface of FIG. 7) arranged in the eighth hollow section 17. The plate thickness d2 of the outside plate 6*b* is practically constant.

Figure 9:
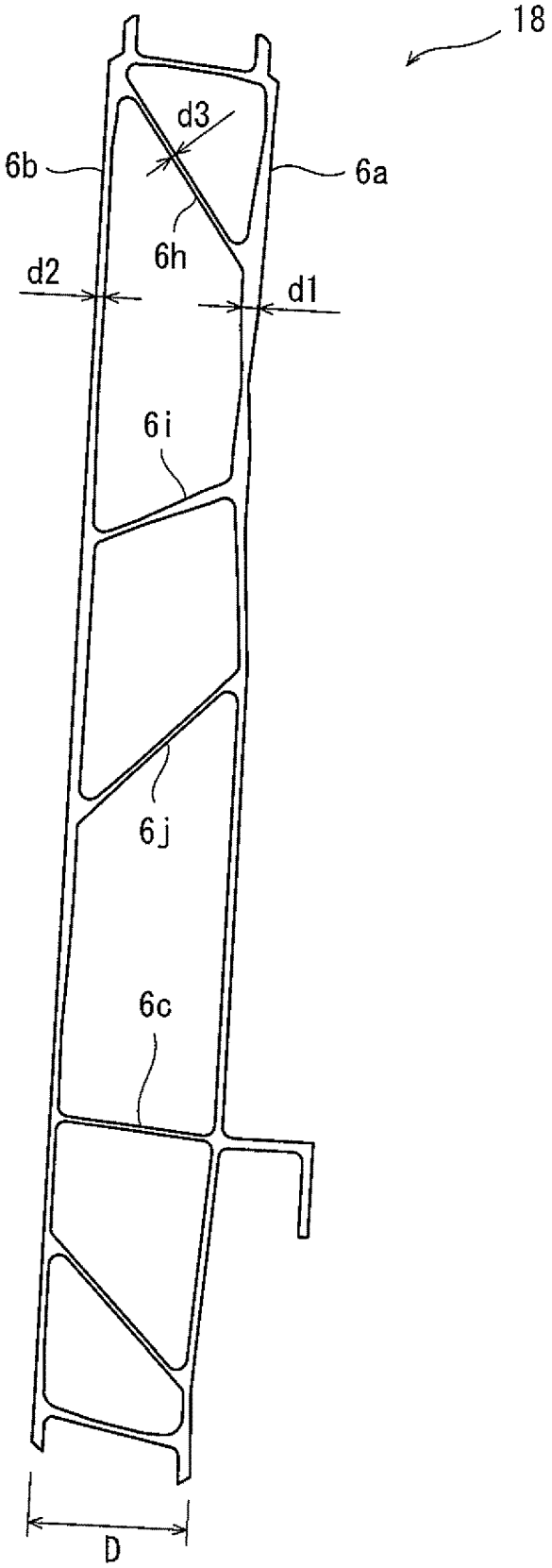
FIG. 9 is a vertical sectional view perpendicular to the car longitudinal direction and showing a ninth hollow section of FIG. 1.

FIG. 9 is a vertical sectional view perpendicular to the car longitudinal direction and showing the ninth hollow section 18 of FIG. 1. As shown in FIG. 9, the plate thickness d1 of the inside plate 6*a* located between coupled portions of the inside plate 6*a* which portions are coupled to respective coupling plates 6*h* and 6*i* adjacently arranged at the upper portion of the ninth hollow section 18 is large, but the plate thickness d1 of the inside plate 6*a* at a lower portion of the ninth hollow section 18 is practically constant. The plate thickness d2 of the outside plate 6*b* is optimized by being finely changed from the middle portion 1*a* of the cantrail toward the lower side of the side bodyshell 3.

In the ninth hollow section 18, when viewed from the car longitudinal direction, any of the plurality of coupling plates 6*c* includes a gradually decreased region having the plate thickness d3 that gradually decreases from one of the car interior side and car exterior side of the car body to the other.

Specifically, each of the plate thicknesses d3 of the two coupling plates 6*i* and 6*j* adjacent to each other at an upper-lower direction inner side of the ninth hollow section 18 becomes a minimum value at an intermediate portion between the inside plate 6*a* and the outside plate 6*b* and gradually decreases from each of the inside plate 6*a* and the outside plate 6*b* toward the intermediate portion.

Figure 10:
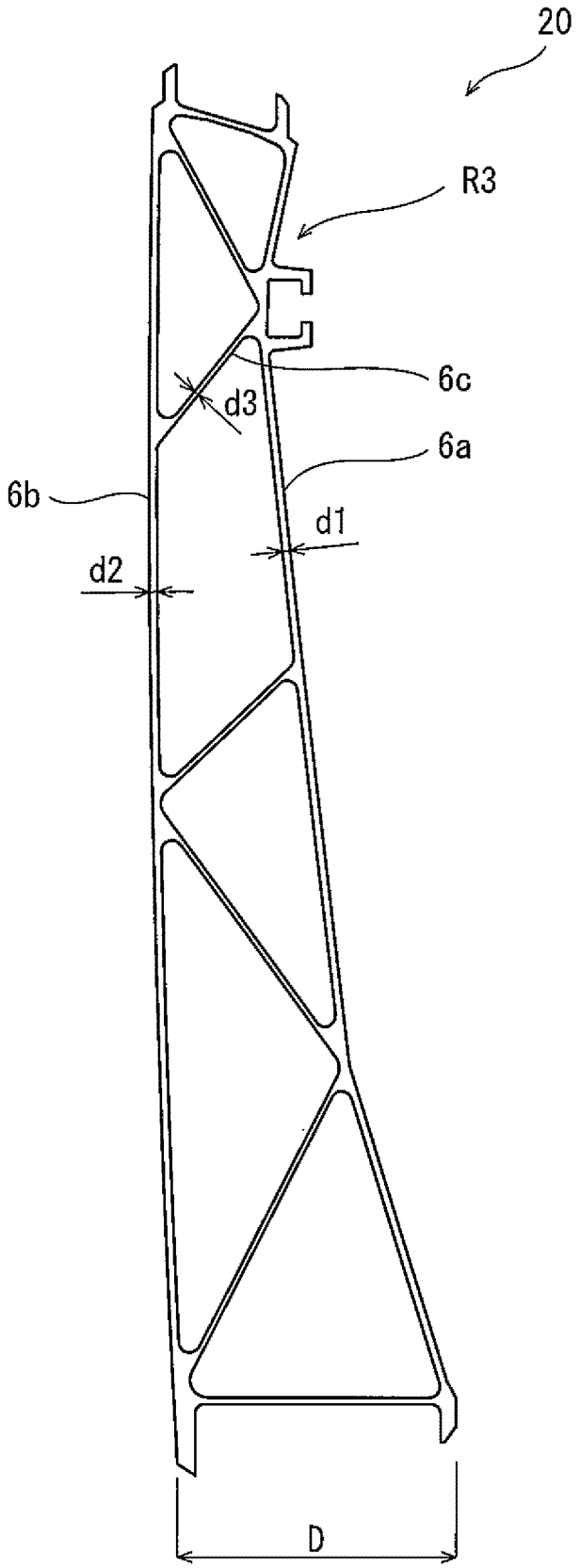
FIG. 10 is a vertical sectional view perpendicular to the car longitudinal direction and showing an eleventh hollow section of FIG. 1.

FIG. 10 is a vertical sectional view perpendicular to the car longitudinal direction and showing the eleventh hollow section 20 of FIG. 1. As shown in FIG. 10, the thickness reduced portion R3 is formed at an upper portion of the eleventh hollow section 20. The thickness (bodyshell thickness D) of the eleventh hollow section 20 increases from the cantrail toward the underframe 2 as a whole. Each of the plate thickness d1 of the inside plate 6*a* and the plate thickness d2 of the outside plate 6*b* is practically constant.

The plate thicknesses d1 to d3 in the above hollow sections 10, 12 to 15, 17, 18, and 20 are just examples and are suitably set in accordance with the magnitude and distribution of the bending moment.

It is thought that the reason why the shear strength of the harmonica type double skin structure is lower than the shear strength of the truss type double skin structure is as below, for example. To be specific, according to the truss type double skin structure, the shear force acting in a direction perpendicular to the circumferential direction of the car body of the railcar bodyshell, i.e., in a direction perpendicular to the inside plate and the outside plate tends to act on the coupling plate as an in-plane force (a compressive force or a pulling force). Therefore, in the truss type double skin structure, the coupling plate effectively resists the shear force. With this, the truss type double skin structure has a relatively high shear strength.

On the other hand, according to the harmonica type double skin structure, the shear force tends to act on the coupling plate as an out-of-plane force. Therefore, in the harmonica type double skin structure, when the shear force acts on the coupling plate, the coupling plate deforms more easily than the coupling plate of the truss type double skin structure. On this account, it is thought that the shear strength of the harmonica type double skin structure is lower than the shear strength of the truss type double skin structure.

As above, when the pressure acts on the railcar bodyshell having the harmonica type double skin structure by the pressure difference between the inside and outside of the car, the harmonica type double skin structure may deform larger and generate higher stress than the truss type double skin section.

Figure 11:
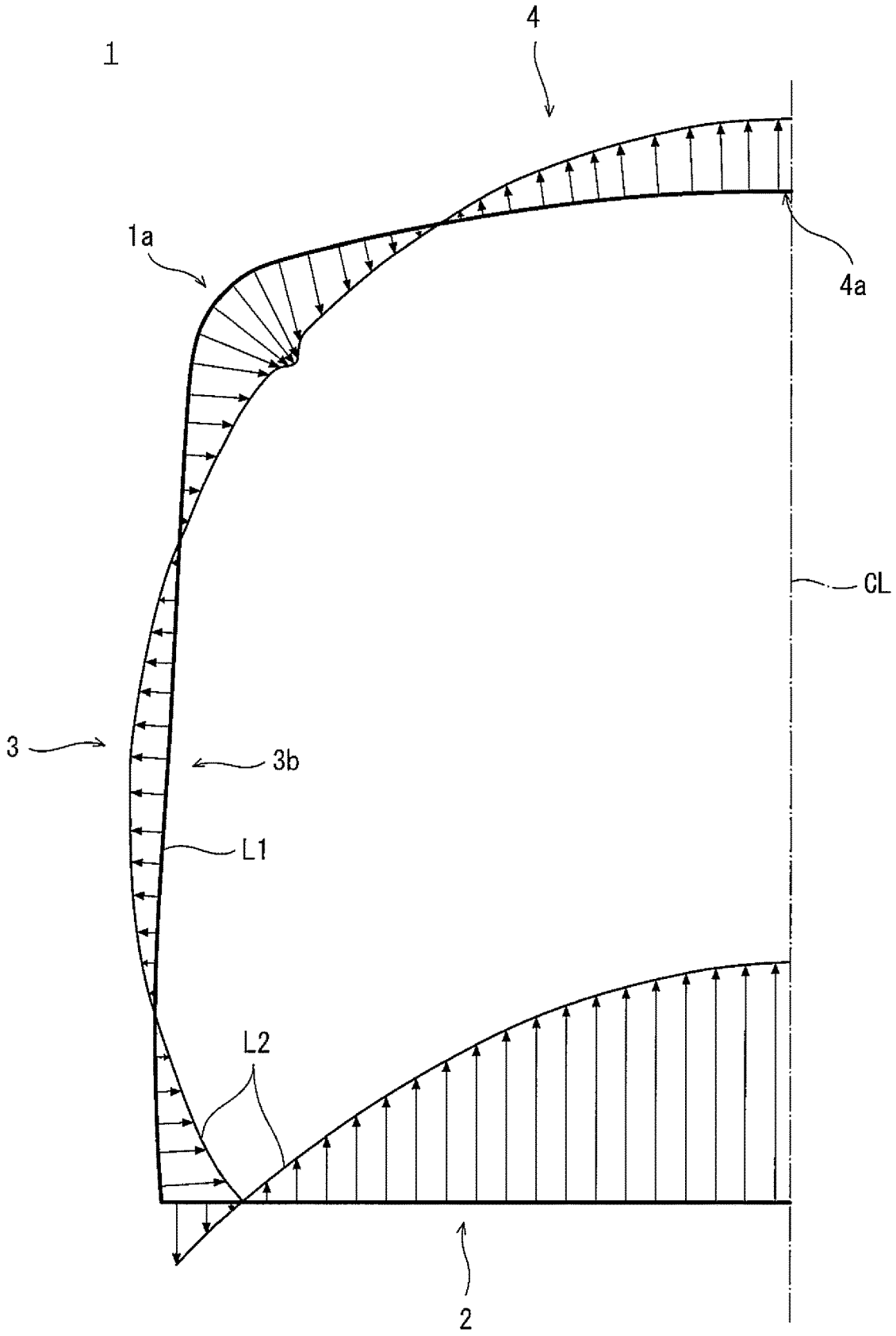
FIG. 11 is a simulation diagram showing the magnitude of a bending moment generated on the railcar bodyshell of FIG. 1 by an atmospheric pressure difference between an inside and outside of the car.

FIG. 11 is a simulation diagram showing the magnitude of the bending moment generated on the railcar bodyshell 1 of FIG. 1 by the atmospheric pressure difference between the inside and outside of the car. In FIG. 11, the longer the length of each arrow is, the larger the bending moment is. The direction of each arrow shows a direction perpendicular to the surface of the railcar bodyshell at the starting point of each arrow. Further, in FIG. 11, a contour line L1 corresponds to a contour line of the railcar bodyshell 1 when viewed from the car longitudinal direction of FIG. 1, and a line L2 shows a line passing through tip ends of a plurality of arrows.

As shown in FIG. 11, an absolute value of the bending moment generated becomes maximum at the car width direction middle portion 4*a* of the roof bodyshell 4, at the middle portion 1*a* of the cantrail, and at the pier panel 3*b* of the side bodyshell 3. Although not shown, it was found from the results of different simulations that even when the atmospheric pressure difference between the inside and outside of the car differs, or even when any one of the atmospheric pressure inside the car and the atmospheric pressure outside the car is higher than the other, the positions where the absolute value of the bending moment becomes the maximum value are substantially the same as the above positions.

The strength of the railcar bodyshell 1 is improved at a portion of the railcar bodyshell 1 at which portion the bending moment is small. With this, the deformation amount of the railcar bodyshell 1 can be reduced. Thus, for example, the number of coupling plates 6*c* can be reduced at the first hollow section 10 corresponding to the middle portion 4*a* of the roof bodyshell 4 and at an upper portion of the eighth hollow section 17 arranged at the pier panel 3*b*.

Figure 12:
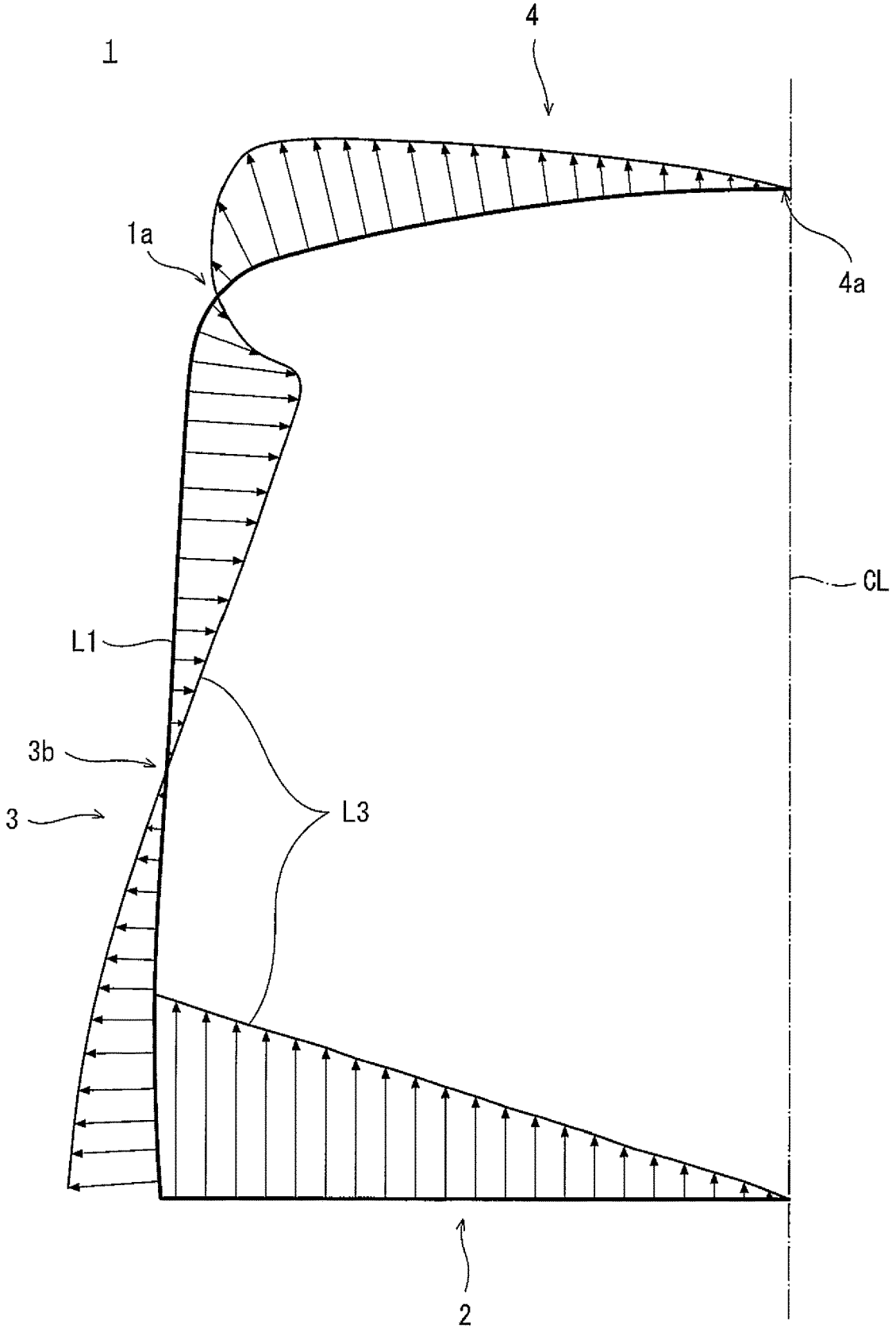
FIG. 12 is a simulation diagram showing the magnitude of a shear force acting on the railcar bodyshell in a direction perpendicular to a circumferential direction of a car body by the bending moment shown in FIG. 11.

FIG. 12 is a simulation diagram showing the magnitude of the shear force acting on the railcar bodyshell 1 in a direction perpendicular to the circumferential direction of the car body by the bending moment shown in FIG. 11. In FIG. 12, the contour line L1 corresponds to the contour line of the railcar bodyshell 1 when viewed from the car longitudinal direction of FIG. 1, and a line L3 is a line passing through tip ends of a plurality of arrows. Further, in FIG. 12, the longer the length of each arrow is, the larger the shear force is. The direction of each arrow shows a direction perpendicular to the surface of the railcar bodyshell 1 at the starting point of each arrow.

As shown in FIG. 12, at the positions where the absolute value of the bending moment becomes the maximum value in a region other than a coupled portion were the side bodyshell 3 and the underframe 2 are coupled to each other in the railcar bodyshell 1, the shear force acting in the perpendicular direction is adequately low.

In consideration of the above and the balance between the strength and the weight, in the railcar bodyshell 1 of the present embodiment, the harmonica type structural portions H1 to H3, the truss type structural portions T1 to T3, and the thickness reduced portions R1 to R3 are arranged at optimal positions, and the bodyshell thickness D and the plate thicknesses d1 to d3 in the railcar bodyshell 1 are optimized.

As described above, in the railcar bodyshell 1 of the present embodiment, the thickness reduced portions R1 to R3 are arranged at the respective regions C1 to C3 of the double skin structure 7 when viewed from the car longitudinal direction. With this, the lengths of the coupling plates 6*c* in the thickness reduced portions R1 to R3 when viewed from the car longitudinal direction can be reduced, and this can reduce the weights of the coupling plates 6*c*. Further, the thickness reduced portions R1 to R3 are arranged at positions where the bending moment of the railcar bodyshell 1 becomes less than the maximum value. With this, the required strength of the railcar bodyshell 1 can be secured. Therefore, while reducing the weight of the railcar bodyshell 1, the railcar bodyshell 1 can endure the pressure load acting on the bodyshell by the differential pressure between the inside and outside of the car without a reinforcing frame.

Further, since the double skin structure 7 of the railcar bodyshell 1 includes the truss type structural portions T1 to T3 and the harmonica type structural portions H1 to H3, the structural portions T1 to T3 and H1 to H3 can be suitably arranged at appropriate positions of the railcar bodyshell 1.

With this, for example, at portions of the railcar bodyshell 1 at which portions the shear force is relatively large, the truss type structural portions T1 to T3 are arranged so as to be adjacent to the harmonica type structural portions H1 to H3, and at portions of the railcar bodyshell 1 at which portions the shear force is relatively small, the harmonica type structural portions H1 to H3 are arranged. With this, while reducing the weight of the railcar bodyshell 1 by the harmonica type structural portions H1 to H3, the strength of the railcar bodyshell 1 can be secured by the truss type structural portions T1 to T3.

The thickness reduced portions R1 to R3 are formed so as to correspond to respective positions where the absolute value of the bending moment generated becomes the minimum value. Therefore, while preventing the strength of the railcar bodyshell 1 from decreasing by providing the thickness reduced portions R1 to R3, the weight of the railcar bodyshell 1 can be satisfactorily reduced.

The harmonica type structural portion (H1, H2, H3) is arranged at a position that is at least one of the middle portion 4*a* of the roof bodyshell 4, the middle portion 1*a* of the car body of the cantrail, and the pier panel 3*b* of the side bodyshell 3.

As described above, even when the pressure load acts on the railcar bodyshell 1 by the atmospheric pressure difference between the inside and outside of the car, the shear force acting on the railcar bodyshell 1 is adequately lower at the middle portion 4*a* of the roof bodyshell 4, the middle portion 1*a* of the cantrail, and the pier panel 3*b* of the side bodyshell 3 than at the other positions of the railcar bodyshell 1. Therefore, by arranging the harmonica type structural portions H1 to H3 at the above positions of the railcar bodyshell 1, the railcar bodyshell 1 can endure the pressure load without the reinforcing frame.

At portions of the railcar bodyshell 1 on which portions the relatively large shear force acts, the truss type structural portions T1 to T3 are arranged so as to be adjacent to the harmonica type structural portions H1 to H3, and at portions of the railcar bodyshell 1 on which portions the relatively small shear force acts, the harmonica type structural portions H1 to H3 are arranged. Therefore, the strength at the positions adjacent to the harmonica type structural portions H1 to H3 of the railcar bodyshell 1 can be secured without the reinforcing frame.

Further, at least one of the inner wall 7*a*, the outer wall 7*b*, and the plurality of coupling plates 6*c* of the double skin structure 7 has different plate thicknesses at a plurality of positions. With this, for example, the plate thickness can be reduced at positions where the strength is relatively high, and the plate thickness can be increased at positions where the strength is relatively low. With this, the required strength of the railcar bodyshell 1 can be obtained while making the weight of the railcar bodyshell 1 smaller than a case where the plate thickness of the entire double skin structure is increased.

When viewed from the car longitudinal direction, any of the plurality of coupling plates 6*c* includes the gradually decreased region having the plate thickness that gradually decreases. Therefore, for example, the strength of the coupling plate 6*c* can be obtained in a region where the plate thickness is relatively large, and the weight of the coupling plate 6*c* can be reduced in a region where the plate thickness is relatively small.

When viewed from the car longitudinal direction, two or more coupling plates 6*c* adjacent to each other in the circumferential direction of the car body among the plurality of coupling plates 6*c* arranged in the harmonica type structural portions H1 to H3 extend in directions intersecting with each other. Therefore, the plurality of coupling plates 6*c* arranged in the harmonica type structural portions H1 to H3 are easily designed. On this account, the degree of freedom of the design of the railcar bodyshell 1 can be improved while reducing the weight of the railcar bodyshell 1.

Since the two or more adjacent coupling plates 6*c* extend in parallel with directions in which the shear force generated acts. Therefore, the required strengths of the coupling plates 6*c* can be obtained while suppressing the weights of the coupling plates 6*c*.

Further, in the plurality of hollow sections 6, the inner wall 7*a* is formed by coupling the plurality of inside plates 6*a*, and the outer wall 7*b* is formed by coupling the plurality of outside plates 6*b*. Therefore, the double skin structure 7 can be configured efficiently.

Further, at least one of the inside plates 6*a*, the outside plates 6*b*, and the coupling plates 6*c* in the hollow sections arranged at the cantrail and the pier panel 3*b* among the plurality of hollow sections 6 has different plate thicknesses at a plurality of positions. Therefore, the required strength of the railcar bodyshell 1 can be easily obtained while reducing the weight of the railcar bodyshell 1.

The present invention is not limited to the above embodiment, and modifications, additions, and eliminations may be made within the scope of the present invention. In the double skin structure, the number of hollow sections forming the outer wall and the inner wall is not limited to the above number described in the embodiment and may be suitably adjusted.

REFERENCE SIGNS LIST

D bodyshell thickness
d1 to d3 plate thickness
H1 to H3 harmonica type structural portion
T1 to T3 truss type structural portion
R1 to R3 thickness reduced portion
1 railcar bodyshell
1*a* middle portion of cantrail
2 underframe
2*a* side sill
2*b* lower portion of side sill
3 side bodyshell

3*b* pier panel
4 roof bodyshell
4*a* middle portion of roof bodyshell
6, 10 to 22 hollow section
6*a* inside plate
6*b* outside plate
6*c*, 6*d* to 6*j* coupling plate
7 double skin structure
7*a* inner wall
7*b* outer wall

The invention claimed is:

1. A railcar bodyshell comprising:
an underframe including a side sill;
a side bodyshell; and
a roof bodyshell, wherein:
the side bodyshell, the roof bodyshell, and the side sill include a double skin structure, the double skin structure including an inner wall, an outer wall, and a plurality of coupling plates coupling the inner wall and the outer wall to each other such that wall surfaces of the inner and outer walls are spaced apart from each other;
the double skin structure includes
a harmonica configured structural portion in which a closed space formed by the inner wall, the outer wall, and two adjacent coupling plates among the plurality of coupling plates is quadrangular when viewed from a car longitudinal direction, and
a truss shaped structural portion which is located adjacent to the harmonica configured structural portion when viewed from the car longitudinal direction and in which a closed space formed by the two coupling plates and one of the inner wall and the outer wall is triangular when viewed from the car longitudinal direction; and
when viewed from the car longitudinal direction, a thickness reduced portion is formed in at least one of a region between a car width direction middle portion of the roof bodyshell and a middle portion of a cantrail, a region between the middle portion of the cantrail and a pier panel of the side bodyshell, and a region between the pier panel of the side bodyshell and the side sill in the double skin structure, the thickness reduced portion being sandwiched between two adjacent thicker regions adjacently located at both sides of the thickness reduced portion in a circumferential direction of a car body and having a bodyshell thickness that is made small in such a manner that the inner wall of the thickness reduced portion is partially depressed toward the outer wall and is arranged outwardly of a car exterior side of the inner wall of the two adjacent thicker regions.

2. The railcar bodyshell according to claim 1, wherein the thickness reduced portion is formed so as to correspond to a position where an absolute value of a bending moment acting on the railcar bodyshell becomes a minimum value when viewed from the car longitudinal direction.

3. The railcar bodyshell according to claim 1, wherein the harmonica configured structural portion is arranged at at least one of the car width direction middle portion of the roof bodyshell, the middle portion of the cantrail, and the pier panel of the side bodyshell.

4. A railcar bodyshell comprising:
an underframe including a side sill;
a side bodyshell; and
a roof bodyshell, wherein:
the side bodyshell, the roof bodyshell, and the side sill include a double skin structure, the double skin structure including an inner wall, an outer wall, and a plurality of coupling plates coupling the inner wall and the outer wall to each other such that wall surfaces of the inner and outer walls are spaced apart from each other;
at least one of the inner wall, the outer wall, and the plurality of coupling plates has different plate thicknesses at a plurality of positions when viewed from a car longitudinal direction; and
when viewed from the car longitudinal direction, a thickness reduced portion is formed in at least one of a region between a car width direction middle portion of the roof bodyshell and a middle portion of a cantrail, a region between the middle portion of the cantrail and a pier panel of the side bodyshell, and a region between the pier panel of the side bodyshell and the side sill in the double skin structure, the thickness reduced portion being sandwiched between two adjacent thicker regions adjacently located at both sides of the thickness reduced portion in a circumferential direction of a car body and having a bodyshell thickness that is made small in such a manner that the inner wall of the thickness reduced portion is partially depressed toward the outer wall and is arranged outwardly of a car exterior side of the inner wall of the two adjacent regions.

5. The railcar bodyshell according to claim 4, wherein any of the plurality of coupling plates includes a gradually decreased region having a plate thickness that gradually decreases from one of a car interior side and car exterior side of the car body to the other.

6. The railcar bodyshell according to claim 4, wherein:
the double skin structure further includes a harmonica configured structural portion in which a closed space formed by the inner wall, the outer wall, and two adjacent coupling plates among the plurality of coupling plates is quadrangular when viewed from the car longitudinal direction; and
when viewed from the car longitudinal direction, two or more coupling plates adjacent to each other in the circumferential direction of the car body among the plurality of coupling plates arranged in the harmonica configured structural portion extend in directions intersecting with each other.

7. The railcar bodyshell according to claim 6, wherein when viewed from the car longitudinal direction, the two or more coupling plates adjacent to each other extend in parallel with directions in which shear force generated by an atmospheric pressure difference between an inside and outside of a car acts.

8. The railcar bodyshell according to claim 1, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

9. The railcar bodyshell according to claim 8, wherein at least one of the inside plate, the outside plate, and the coupling plates in the hollow section arranged so as to correspond to at least one of the cantrail and the pier panel among the plurality of hollow sections has different plate thicknesses at a plurality of positions when viewed from the car longitudinal direction.

10. The railcar bodyshell according to claim 2, wherein the harmonica configured structural portion is arranged at at least one of the car width direction middle portion of the roof bodyshell, the middle portion of the cantrail, and the pier panel of the side bodyshell.

11. The railcar bodyshell according to claim 5, wherein when viewed from the car longitudinal direction, two or more coupling plates adjacent to each other in the circumferential direction of the car body among the plurality of coupling plates arranged in the harmonica configured structural portion extend in directions intersecting with each other.

12. The railcar bodyshell according to claim 11, wherein when viewed from the car longitudinal direction, the two or more coupling plates adjacent to each other extend in parallel with directions in which shear force generated by an atmospheric pressure difference between an inside and outside of a car acts.

13. The railcar bodyshell according to claim 2, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

14. The railcar bodyshell according to claim 3, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

15. The railcar bodyshell according to claim 4, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

16. The railcar bodyshell according to claim 5, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

17. The railcar bodyshell according to claim 6, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

18. The railcar bodyshell according to claim 7, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

19. The railcar bodyshell according to claim 10, wherein:
the side bodyshell and the roof bodyshell include a plurality of hollow sections;
each of the plurality of hollow sections includes
an inside plate arranged at a car interior side of the car body,
the coupling plates; and
an outside plate arranged at a car exterior side of the car body and coupled to the inside plate by the coupling plates such that plate surfaces of the inside and outside plates are spaced apart from each other; and
in the plurality of hollow sections, the inner wall is formed by coupling the plurality of inside plates, and the outer wall is formed by coupling the plurality of outside plates.

20. The railcar bodyshell according to claim 15, wherein at least one of the inside plate, the outside plate, and the coupling plates in the hollow section arranged so as to correspond to at least one of the cantrail and the pier panel among the plurality of hollow sections has different plate thicknesses at a plurality of positions when viewed from the car longitudinal direction.

* * * * *